United States Patent [19]

Mamiya et al.

[11] Patent Number: 4,669,439

[45] Date of Patent: Jun. 2, 1987

[54] AIR-TO-FUEL RATIO CONTROL SYSTEMS FOR INTERNAL COMBUSTION ENGINES

[75] Inventors: Kiyotaka Mamiya, Higashihiroshima; Toshiyuki Terashita; Katsumi Okazaki, both of Hiroshima; Tadataka Nakazumi, Kure, all of Japan

[73] Assignee: Mazda Motor Corporation, Japan

[21] Appl. No.: 772,548

[22] Filed: Sep. 4, 1985

[30] Foreign Application Priority Data

Sep. 10, 1984 [JP] Japan ..... 59-189255

[51] Int. Cl.[4] ..... F02D 41/14

[52] U.S. Cl. ..... 123/489; 123/440

[58] Field of Search ..... 123/440, 489, 486

[56] References Cited

U.S. PATENT DOCUMENTS

| | | | |
|---|---|---|---|
| 4,351,281 | 9/1982 | Geiger et al. | 123/418 X |
| 4,365,299 | 12/1982 | Kondo et al. | 123/440 X |
| 4,445,481 | 5/1984 | Aoki et al. | 123/489 X |
| 4,566,420 | 1/1986 | Sakamoto et al. | 123/489 |

*Primary Examiner*—Tony M. Argenbright
*Attorney, Agent, or Firm*—Gerald J. Ferguson, Jr.; Michael P. Hoffman; Ronni S. Malamud

[57] ABSTRACT

An air-to-fuel ratio control system for an internal combustion engine comprises means for performing a feedback control for keeping a fuel mixture to have the theoretical air-to-fuel ratio or approximations thereof in response to the output of an air-to-fuel ratio sensor, means for conducting the learning to compute a supplemental feedback quantity of fuel used for revising the quantity of fuel by which the fuel actually supplied is determined in at least one of partitions of the operating condition of the engine under the feedback control, means for memorizing the supplemental feedback quantity of fuel in at least one of memorizing areas partitioned in accordance with the partitions of the operating condition of the engine as a resultant of the learning, means for renewing the resultant of the learning in each of the remaining memorizing areas on the strength of the resultant of the learning newly memorized in at least one of memorizing areas, and means for supplying the fuel of the quantity computed with the renewed resultant of the learning in each memorizing area so as to produce the fuel mixture having a desired air-to-fuel ratio different from the theoretical air-to-fuel ratio and approximations thereof through an open-loop control under the situations where the operation of the engine meets predetermined conditions.

13 Claims, 8 Drawing Figures

AIR-TO-FUEL RATIO CONTROL SYSTEMS FOR INTERNAL COMBUSTION ENGINES

BACKGROUND OF THE INVENTION

1. Field of the Invention

The present invention relates generally to air-to-fuel ratio control systems for internal combustion engines, and more particularly, to a system for controlling an air-to-fuel ratio of a fuel mixture provided for combustion in an internal combustion engine employed in a vehicle to be of a value different from the value of the theoretical air-to-fuel ratio when the operation of the engine meets predetermined specific conditions.

2. Description of the Prior Art

In an internal combustion engine employed in a vehicle and accompanied with a ternary catalyst converter for purifying the exhaust gas therefrom, it is generally preferable to keep the air-to-fuel ratio of a fuel mixture supplied to a combustion chamber at the value of the theoretical air-to-fuel ratio or a value approximating thereto, because the purification effect for the exhaust gas is advanced theoretically under the condition wherein the fuel mixture has the theoretical air-to-fuel ratio. Because of this, an air-to-fuel ratio control system was proposed in which the air-to-fuel ratio of the fuel mixture is subjected to a feedback-control performed in response to the output of an air-to-fuel ratio sensor, such as an oxygen sensor located in an exhaust passage from the engine for detecting oxygen gas contained in the exhaust gas, so as to be of a value in a relatively narrow range including the value of the theoretical air-to-fuel ratio.

On the other hand, in view of improving fuel consumption in the engine, it is sometimes desired to cause the fuel mixture to have an air-to-fuel ratio larger than the theoretical air-to-fuel ratio so as to provide a lean mixture or, an air-to-fuel ratio smaller than the theoretical air-to-fuel ratio so as to provide a rich mixture which may be appropriate for the situation wherein the engine is required to produce relatively large power for accelerating the vehicle. But, because the air-to-fuel ratio sensor previously proposed and generally used in the feedback-control for the air-to-fuel ratio of the fuel mixture is so constituted as to produce an output which varies in level to high from low or vice versa in the condition wherein the fuel mixture has the theoretical air-to-fuel ratio, it is quite difficult to keep the air-to-fuel ratio of the fuel mixture at a value larger or smaller than the value of the theoretical air-to-fuel ratio through such a feedback control performed in response to the output of the air-to-fuel ratio sensor as discussed above.

Accordingly, in the air-to-fuel ratio control system proposed previously, when the fuel mixture is maintained with an air-to-fuel ratio larger or smaller than the theoretical air-to-fuel ratio, the air-to-fuel ratio of the fuel mixture is subjected to a open-loop control in which the fundamental quantity of fuel is calculated on the strength of engine speed and engine load which varies in proportion to air flow in an intake passage to the engine or air pressure arising in the intake passage, and revised to produce a final quantity of fuel, and then the fuel mixture supplied to the combustion chamber of the engine is controlled so as to contain the fuel of the final quantity. However, in such a system wherein the open-loop control for the air-to-fuel ratio of the fuel mixture is performed in the manner mentioned above, the control is easily influenced by the secular change in the characteristic of the engine or variations in the driving conditions of the vehicle so as to be unstable or deteriorate in accuracy, so that it is difficult to properly keep the desired air-to-fuel ratio of the fuel mixture.

Then, as described in, for example, the Japanese patent application published before examination with the publication No. 57/105530 on July 1, 1982, another air-to-fuel ratio control system, in which a control for keeping the fuel mixture having a desired air-to-fuel ratio different from the theoretical air-to-fuel ratio is performed almost stably without being easily influenced by the secular change in the characteristic of the engine, has been proposed. In such a system, the feedback control for keeping the air-to-fuel ratio of the fuel mixture being of a value in a relatively narrow range including the value of the theoretical air-to-fuel ratio is carried out and the learning function for obtaining a supplemental feedback quantity of fuel used for revising therewith the quantity of fuel by which the fuel actually supplied to the combustion chamber is determined is performed under that feedback control. Then, when the open-loop control for keeping the air-to-fuel ratio of the fuel mixture being of the value different from the value of the theoretical air-to-fuel ratio is carried out, the quantity of fuel by which the fuel actually supplied to the combustion chamber is determined is revised based on the supplemental feedback quantity of fuel obtained through the learning function, so that the fuel mixture is maintained so as to have a desired air-to-fuel ratio different from the theoretical air-to-fuel ratio and approximations thereof.

In such a previously proposed air-to-fuel ratio control system wherein the quantity of fuel by which the fuel actually supplied to the combustion chamber is determined is revised with a result of the learning function performed under the feedback control when the open-loop control for the air-to-fuel ratio of the fuel mixture is carried out, a single supplemental feedback quantity of fuel obtained through the learning function performed in a certain operating condition of the engine is used for revising the quantity of fuel by which the fuel actually supplied to the combustion chamber is determined in the whole operating condition of the engine. However, because the quantity of the fuel actually desired to be supplied to the combustion chamber is varied in accordance with the operating condition of the engine, although the quantity of fuel by which the fuel actually supplied to the combustion chamber is determined is revised based on the supplemental feedback quantity of fuel obtained through the learning function so that the desired air-to-fuel ratio of the fuel mixture is obtained in the certain operating condition of the engine, for example, in the condition wherein the engine works with a relatively light load under the open-loop control, errors in the open-loop control may arise so that the desired air-to-fuel ratio of the fuel mixture can not be obtained properly in other operating conditions of the engine, for example, in the condition wherein the engine works with a relatively heavy load.

Accordingly, there is proposed such a modified control system as mentioned below. In the modified control system, the feedback control for keeping the air-to-fuel ratio of the fuel mixture having a value in a relatively narrow range including the value of the theoretical air-to-fuel ratio is carried out in each of a plurality of partitions of the operating condition of the engine (hereinafter, each of such partitions will be referred to as an operating partition) and the learning function for obtaining a supplemental feedback quantity of fuel used for revising therewith the quantity of fuel by which the fuel actually supplied to the combustion chamber is determined is performed under that feedback control in each operating partition. The supplemental feedback quantity of fuel obtained through the learning function in each operating partition is memorized as a resultant of the learning function in a corresponding memorizing area partitioned in a memory device in accordance with, or corresponding to the operating partitions. Then, whenever the engine is started working, in each operating partition, the resultant of the learning function in the corresponding memorizing area is renewed. Subsequently, the open-loop control for the air-to-fuel ratio of the fuel mixture is carried-out, so that the quantity of fuel by which the fuel actually supplied to the combustion chamber is determined is revised with the resultant of the learning function obtained in response to the operating condition of the engine.

With this proposed air-to-fuel ratio control system, in each operating partition, the fuel mixture is caused to have the theoretical air-to-fuel ratio or approximations thereof under the feedback control performed for obtaining the supplemental feedback quantity of fuel through the learning function, and also caused to have a desired air-to-fuel ratio different from the theoretical air-to-fuel ratio or approximations thereof under the open-loop control. For example, in the case where the open-loop control for keeping the fuel mixture having an air-to-fuel ratio larger than the theoretical air-to-fuel ratio or approximations thereof is performed, as shown with a dot-dash line in FIG. 1 with the axis of abscissa representing the time (t) and the axis of ordinate representing the air-to-fuel ratio (A/F), the air-to-fuel ratio of the fuel mixture is maintained at the value of the theoretical air-to-fuel ratio (14.7) and approximations thereof during each of periods $H_1$, $H_2$, $H_3$, $H_4$, . . . in respective operating partitions Za, Zb, Zc, Zd, . . . , in which the feedback control is performed, and then kept to be of the desired value (18) larger than the value of the theoretical air-to-fuel ratio and approximations thereof during each of periods $G_1$, $G_2$, $G_3$, $G_4$, . . . successive respectively to the periods $H_1$, $H_2$, $H_3$, $H_4$, . . . in respective operating partitions Za, Zb, Zc, Zd, . . . , in which the open-loop control is performed, that is, the change in the fuel mixture to lean from theoretical occurs in each of the operating partitions Za, Zb, Zc, Zd, . . . . Accordingly, the air-to-fuel ratio of the fuel mixture is suddenly varied at each transition between the period during which the feedback control is performed and the period during which the open-loop control is performed, so that undesirable variations in torque produced by the engine may arise frequently.

Further, in the case mentioned above, it is required to have the period, such as each of $H_1$, $H_2$, $H_3$, $H_4$, . . . , in which the feedback control for obtaining the supplemental feedback quantity of fuel through the learning function is performed before the corresponding period, such as each of $G_1$, $G_2$, $G_3$, $G_4$, . . . , in which the open-loop control for keeping the fuel mixture having the desired air-to-fuel ratio larger than the theoretical air-to-fuel ratio or approximations thereof is performed in each operating partition, such as each of Za, Zb, Zc, Zd, . . . , and therefore the start of the open-loop control may be undesirably delayed in each operating partition.

OBJECTS AND SUMMARY OF THE INVENTION

Accordingly, it is an object of the present invention to provide an air-to-fuel ratio control system for an internal combustion engine, which avoids the foregoing disadvantages and problems encountered with the prior art.

Another object of the present invention is to provide an air-to-fuel ratio control system for an internal combutsion engine, in which a feedback control for keeping the air-to-fuel ratio of a fuel mixture being at a value in a relatively narrow range including the value of the theoretical air-to-fuel ratio is carried out so as to obtain a supplemental feedback quantity of fuel through the learning for each of a plurality of partitions of the operating condition of the engine (operating partitions) and to memorize the supplemental feedback quantity of fuel obtained through learning in a memory as a resultant of the learning function, and the quantity of fuel by which the fuel actually supplied to a combustion chamber of the engine is determined is revised with the memorized resultant of the learning function when an open-loop control for keeping the air-to-fuel ratio of the fuel mixture being of a value different from the value of the theoretical air-to-fuel ratio or approximations thereof is performed in succession to the feedback control, and which can reduce undesirable variations in torque produced by the engine arising at each transition between a period during which the feedback control is performed and a period during which the open-loop control is performed in the situation wherein the resultant of the learning function in the memory is renewed.

A further object of the present invention is to provide an air-to-fuel ratio control system for an internal combustion engine, in which a feedback control for keeping the air-to-fuel ratio of a fuel mixture being of a value in a relatively narrow range including the value of the theoretical air-to-fuel ratio is carried out so as to obtain a supplemental feedback quantity of fuel through the learning function for each of operating partitions and to memorize the supplemental feedback quantity of fuel obtained through learning in a memory as a resultant of the learning function, and the quantity of fuel by which the fuel actually supplied to a combustion chamber of the engine is determined is revised with the memorized resultant of the learning function when an open-loop control for keeping the air-to-fuel ratio of the fuel mixture being of a value different from the value of the theoretical air-to-fuel ratio or approximations thereof is performed in succession to the feedback control, and which can substantially minimize an undesirable delay in the switchover of the feedback control to the open-loop control under the situation where the operation of the engine meets predetermined conditions for the open-loop control.

According to an aspect of the present invention, there is provided an air-to-fuel ratio control system for an internal combustion engine, which comprises an air-to-fuel ratio sensor for producing an output varying in the condition wherein a fuel mixture supplied to a combustion chamber of the engine has the theoretical air-to-fuel ratio, feedback control means operative to keep the air-to-fuel ratio of the fuel mixture at a value in a relatively narrow range including the value of the theoretical air-to-fuel ratio through a feedback control performed in response to the output of the air-to-fuel ratio sensor, operation detecting means for detecting the operation of the engine, computing means operative to cause the feedback control means to operate in order to conduct the learning function for computing a supplemental feedback quantity of fuel used for revising the quantity of fuel by which the fuel actually supplied to the combustion chamber is determined in at least one of a plurality of partitions of the operating condition of the engine when the operation of the engine detected by the operation detecting means meets predetermined conditions, memory means for memorizing the supplemental feedback quantity of fuel computed by the computing means in the respective memorizing areas therein partitioned in accordance with the partitions of the operating condition of the engine as a resultant of the learning function, first memory renewing means for causing the computing means and memory means to operate for renewing the resultant of the learning function in at least one of the memorizing areas of the memory means, second memory renewing means for renewing the resultant of the learning function in each memorizing area other than at least one on the strength of the resultant of the learning function renewed by the first memory renewing means, renewal detecting means for detecting the termination of renewal of the resultants of the learning function by each of the first and second memory renewing means, and fuel supply control means for supplying the fuel of the quantity computed with the resultants of the learning function memorized in the memory means so as to produce the fuel mixture having an air-to-fuel ratio different from the theoretical air-to-fuel ratio and approximations thereof after the detection by the renewal detection means until the termination of the engine operation through an open-loop control under the situation where the operation of engine meets another predetermined conditions.

In the air-to-fuel ratio control system thus constituted in accordance with the present invention, the number of times of variations in the air-to-fuel ratio of the fuel mixture supplied to the combustion chamber, which arise suddenly at each transition to the feedback control for the air-to-fuel ratio of the fuel mixture from the open-loop control for the air-to-fuel ratio of the fuel mixture or vice versa, is minimized, and therefore undesirable variations in torque produced by the engine, which result from such variations in the air-to-fuel ratio of the fuel mixture, are effectively reduced. Accordingly, the open-loop control for keeping the fuel mixture to have the air-to-fuel ratio different from the theoretical air-to-fuel ratio and approximations thereof is carried out accurately in each partition of the operating condition of the engine with enough reduced undesirable variations in torque produced by the engine.

Further, an undesirable delay of the start of the open-loop control, which could occur in each partition of the operating condition of the engine, is substantially avoided, so that the switchover of the feedback control to the open-loop control is achieved quickly whenever the open-loop control is required.

The above, and other objects, features and advantages of the present invention will become apparent from the following detailed description which is to be read in conjunction with the accompanying drawings.

DESCRIPTION OF THE PREFERRED EMBODIMENT

Figure 2:
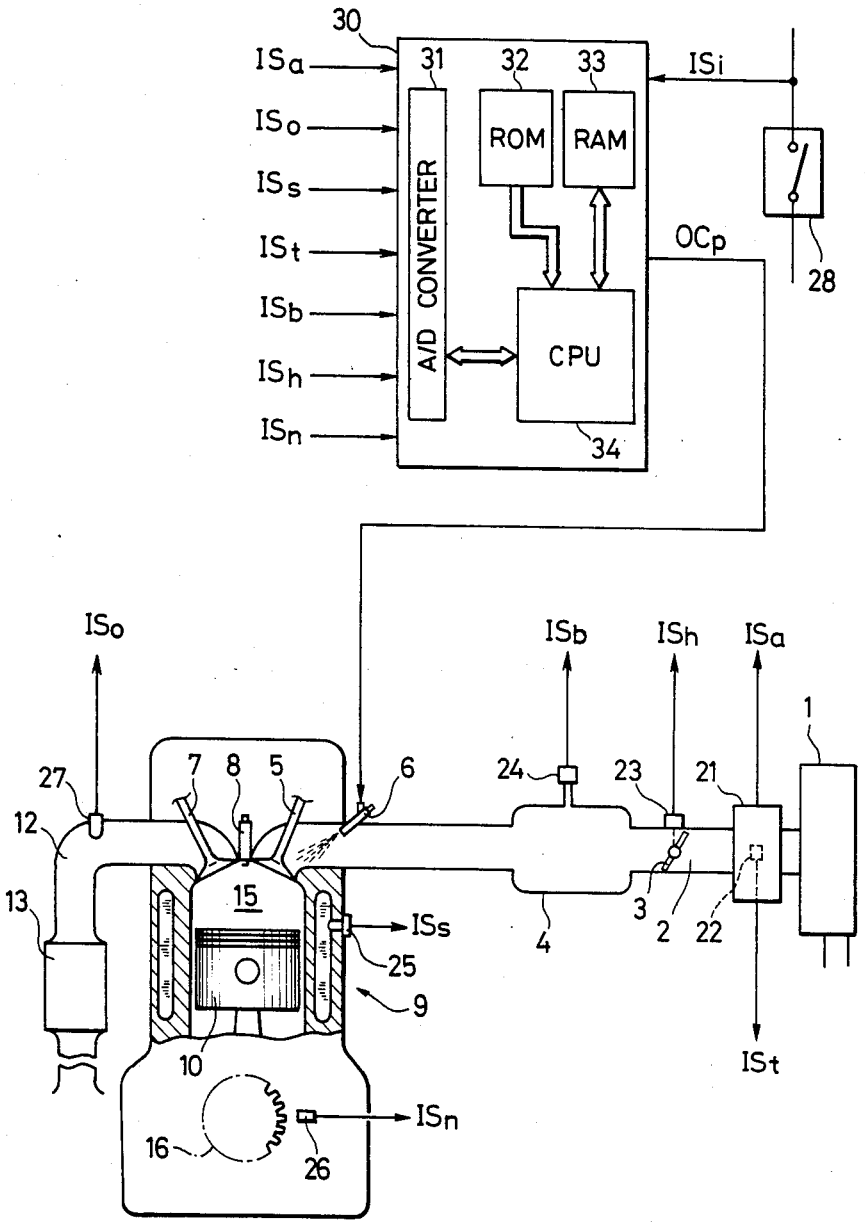
FIG. 2 is a schematic illustration showing one embodiment of air-to-fuel ratio control system for an internal combustion engine according to the present invention, together with an essential part of an engine to which the embodiment is applied.

An embodiment of air-to-fuel ratio control system for an internal combustion engine according to the present invention is schematically shown in FIG. 2, together with an essential part of an engine to which the embodiment is applied.

Referring to FIG. 2, an air flow introduced through an air cleaner 1 into an intake passage 2 is detected by an air flow sensor 21 and a detection output signal ISa varying in response to the detected air flow is supplied from the air flow sensor 21 to a control unit 30. The temperature of the air flow passing through the air flow sensor 21 is detected by a thermometer 22 and a detection output signal ISt varying in response to the detected temperature is also supplied from the thermometer 22 to the control unit 30. The air flow in the intake passage 2 is adjusted by a throttle valve 3 which is controlled by an accelerator pedal (not shown in the drawings) to vary its opening degree. The opening degree of the throttle valve 3 is detected by a throttle sensor 23 and a detection output signal ISh varying in response to the detected opening degree is supplied to the control unit 30. The air flow having passed through the throttle valve 3 is supplied through a surge tank 4 and an inlet valve 5 to a combustion chamber 15 formed in an engine body 9. An air pressure gauge 24 is attached to the surge tank 4 and a detection output signal ISb varying in response to the air pressure detected by the air pressure gauge 24 is supplied from the air pressure gauge 24 to the control unit 30.

A fuel injector 6, which is controlled to be open and shut by an injection control pulse signal OCp supplied from the control unit 30, is attached to the intake passage 2 so as to inject intermittently at a predetermined period fuel pressurized by a fuel feeding device (not shown in the drawings) into the intake passage 2 in the direction to the downstream portion thereof to produce a fuel mixture. The fuel mixture is guided into the combustion chamber 15 and ignited by a spark plug 8 to burn therein.

When the engine is in operation, a rotary disc 16, which is provided in relation to a crank shaft which is rotated because of the reciprocating movement of a piston 10 in the engine body 9, is rotated in synchronism with the rotation of the crank shaft. The rotation speed of the rotary disc 16, which is in proportion to the engine speed, is detected by a rotation sensor 26 and a detection output signal ISn varying in response to the engine speed is supplied from the rotation sensor 26 to the control unit 30. Further, the temperature of the coolant in the engine is detected by a coolant temperature gauge 25 mounted on the engine body 9, and a detection output signal ISs varying in response to the detected temperature is supplied from the coolant temperature gauge 25 to the control unit 30.

From the combustion chamber 15, exhaust gas is guided through an exhaust valve 7 into an exhaust passage 12. An oxygen sensor 27 which acts as an air-to-fuel ratio sensor is attached to the exhaust passage 12 to detect oxygen gas contained in the exhaust gas passing through the exhaust passage 12. A detection output signal ISo obtained from the oxygen sensor 27 varies in level to high from low or vice versa on the condition where the fuel mixture supplied to the combustion chamber 15 has the theoretical air-to-fuel ratio or approximations thereof. That is, the oxygen sensor 27 detects oxygen gas contained in the exhaust gas and produces, on the strength of the detected oxygen gas, the detection output signal ISo. The detection output signal ISo has a first level in the case wherein the fuel mixture supplied to the combustion chamber 15 has an air-to-fuel ratio larger than the theoretical air-to-fuel ratio or approximations thereof so as to be lean, and a second level different from the first level in the case where the fuel mixture supplied to the combustion chamber 15 has an air-to-fuel ratio smaller than the theoretical air-to-fuel ratio or approximations thereof so as to be rich. The detection output signal ISo thus obtained is supplied from the oxygen sensor 27 to the control unit 30. At a portion of the exhaust passage 12 further downstream than the oxygen sensor 27, a ternary catalyst converter 13 operative to reduce HC, Co and NOx components in the exhaust gas is provided to purifying the exhaust gas.

The control unit 30 to which the detection output signals ISa, ISt, ISh, ISb, ISs, ISn and ISo each, obtained as discussed above, are supplied, comprises an analog to digital converter (A/D converter) 31, a read-only memory (ROM) 32, a random access memory (RAM) 33 and a central processing unit (CPU) 34 forming a microcomputer together. An ignition signal ISi varying in response to the ON and OFF states of an ignition key switch 28 is also supplied to the control unit 30, so that the control unit 30 can detect that the ignition key switch 28 is turned on to keep the engine operating and that the ignition key switch 28 is turned off to keep the engine inoperative. The CPU 34 in the control unit 30 is operative to perform operations based on the data obtained from the respective detection output signals aforementioned in compliance with commands from the ROM 32 and in communication with the RAM 33, and to produce output data representing the quantity of fuel by which the fuel injected from the fuel injector 6 is determined and the timing for injection. The injection control pulse signal OCp is produced in accordance with such output data of the CPU 34 in the control unit 30 and supplied to the fuel injector 6.

With this arrangement, when the ignition key switch 28 is turned on to cause the engine to operation, the control unit 30 computes a fundamental or starting quantity of fuel Qs based on the engine speed Ne represented by the detection output signal ISn and the air flow represented by the detection output signal ISa, and revises, as occasion demands, the fundamental quantity of fuel Qs in response to the coolant temperature Tw represented by the detection output signal ISs, the air flow temperature represented by the detection output signal ISt, and so on, to produce a final quantity of fuel Qe. Then, the control unit 30 generates the injection control pulse signal OCp in accordance with the final quantity of fuel Qe, so as to cause the fuel injector 6 to inject the fuel of the final quantity of fuel Qe.

When the operation of the engine meets predetermined learning conditions, for example, such conditions that the coolant temperature Tw is equal to or higher than a predetermined value $T_1$ so that the warming-up operation of the engine is completed, the voltage level of the detection output signal ISo from the oxygen sensor 27 is equal to or higher than a predetermined value which indicates a correct operation of the oxygen sensor 27, for example, 0.6 volts, and the differential coefficient $d\theta/dt$ for the opening degree of the throttle $\theta$ represented by the detection output signal ISh is in a predetermined range ($\alpha \leqq d\theta/dt < \beta$), that is, the vehicle employing this engine is not in the acceleration or the deceleration state, the control unit 30 commences a feedback control for keeping the air-to-fuel ratio of the fuel mixture supplied to the combustion chamber 15 at a value within a relatively narrow range which includes the value of the theoretical air-to-fuel ratio, in response to the detection output signal ISo from the oxygen sensor 27. Under such a feedback control, as shown in FIG. 3, the fuel supply from the fuel injector 6 is increased and decreased alternately with reference to the value corresponding to the theoretical air-to-fuel ratio.

Figure 1:
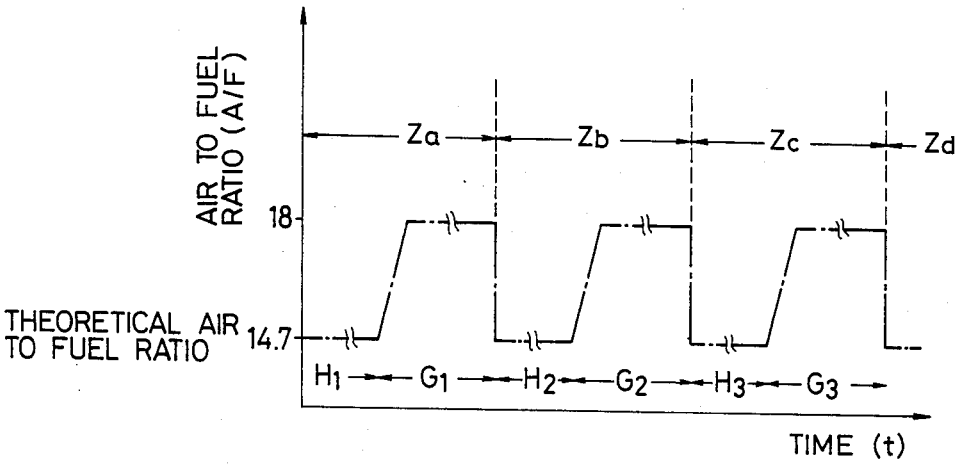
FIG. 1 is a diagram used for explaining the operation of an air-to-fuel ratio control system, the problem encountered with which is solved by the present invention.
Figure 3:
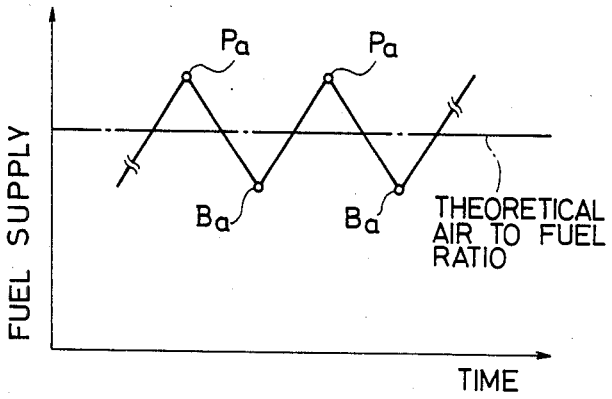
FIG. 3 is a characteristic diagram used for explaining the operation of the embodiment shown in FIG. 2.

In the situation where the feedback control for the air-to-fuel ratio of the fuel mixture is carried out, the control unit 30 performs the learning function to obtain an average quantity between a peak quantity Pa and a bottom quantity Ba of the fuel supply shown in FIG. 3. The control unit 30 then computes a supplemental feedback quantity of fuel Fb for supplementing excess and deficiency in the fundamental quantity of fuel Qs as a base on which the final quantity of fuel Qe corresponding to the average quantity obtained from the peak quantity Pa and the bottom quantity Ba are computed, and then memorizes or stores the computed supplemental feedback quantity of fuel Fb in a predetermined memorizing or storage portion in the RAM 33 as a resultant of the learning function Gf. Such learning by the control unit 30 is performed, for example, eight times repeatedly for one of a plurality of partitions of the operating condition of the engine and, after the eight times, an average among the eight resultants of the learning function $Gf_1 \sim Gf_8$, namely, an average resultant of the learning function, Gfa, is computed. The average resultant of the learning function Gfa thus computed is memorized in a memorizing area of the RAM 33 corresponding to the partition of the operating condition of the engine for which the learning function is performed eight times, so as to renew a former average resultant of the learning Gfa previously memorized therein.

Figure 4:
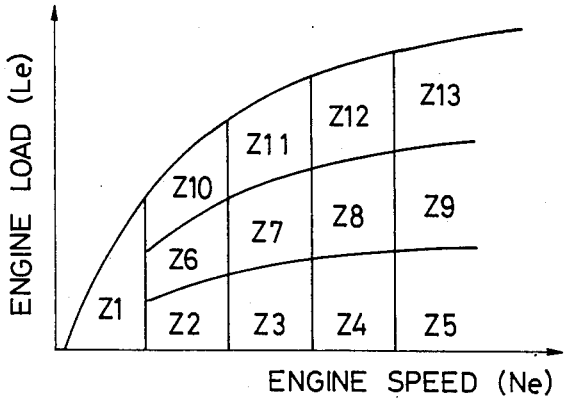
FIG. 4 is a diagram used for explaining an example of a map for learning applicable to a control unit employed in the embodiment shown in FIG. 2.
Figure 6:
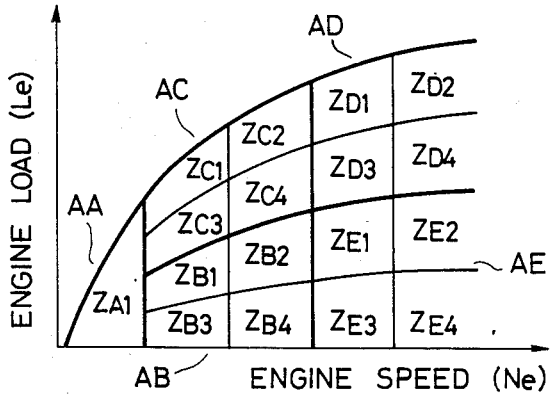
FIG. 6 is a diagram used for explaining another example of the map for learning applicable to the control unit employed in the embodiment shown in FIG. 2.

The RAM 33 has a plurality of memorizing areas so partitioned as to correspond to such a map for learning as shown in FIG. 4 or FIG. 6 with the axis of abscissa representing the engine speed (Ne) and the axis of ordinate representing the engine load (Le). In the map for learning shown in FIG. 4, the operating condition of the engine is divided into a plurality of operating partitions Z1, Z2, Z3, . . . , and in the map for learning shown in FIG. 6, the operating condition of the engine is divided into a plurality of operating partitions $Z_{A1}$, $Z_{B1} \sim Z_{B4}$, $Z_{C1} \sim Z_{C4}$, $Z_{D1} \sim Z_{D4}$, . . . . Further, in the map for learning shown in FIG. 6, the operating partition $Z_{A1}$ formes a partition block AA and the operating partitions $Z_{B1} \sim Z_{B4}$, $Z_{C1} \sim Z_{C4}$, $Z_{D1} \sim Z_{D4}$, . . . form partition blocks AB, AC, AD, . . . , respectively. Each of the memorizing areas of the RAM 33 is used for memorizing the average resultant of the learning function, Gfa, computed with respect to a corresponding one of the operating partitions in the map of learning shown in FIG. 4 or FIG. 6. The average resultant of the learning function, Gfa, memorized in each of the memorizing areas of the RAM 33 is renewed whenever the engine starts operating.

The renewal of the average resultant of the learning function, Gfa, in each memorizing area of the RAM 33 is carried out by the CPU 34 in such a manner as discussed below.

When all memorizing areas of the RAM 33 corresponding to the respective operating partitions in the map for learning shown in FIG. 4 or FIG. 6 are empty, that is, the learning function has not been performed for any operating partitions, the average resultant of the learning function, Gfa, obtained first and memorized in one of the memorizing areas of the RAM 33 corresponding to the operating partition for which the learning function is performed eight times, is memorized in all of remaining memorizing areas of the RAM 33. Then, after the whole memorizing areas of the RAM 33 are filled up once, the average resultant of the learning function, Gfa, newly obtained for one of the operating partitions is memorized in the corresponding memorizing area of the RAM 33 so as to renew the average resultant of the learning function, Gfa, previously memorized therein. Further, for example, an average between the average resultant of the learning function Gfa, newly obtained and a former average resultant of the learning function, Gfa, previously memorized in each of the whole remaining memorizing areas of the RAM 33 is computed and memorized in each of the whole remaining memorizing areas of the RAM 33 in place of the former average resultant of the learning function, Gfa, memorized therein, whenever the engine starts to operate. As a result of this, it is not necessary to conduct the feedback control for the air-to-fuel ratio of the fuel mixture for obtaining the average resultant of the learning repeatedly and independently for each of the operating partitions.

After the renewal of the average resultant of the learning function, Gfa, in each of the memorizing areas of the RAM 33 is thus completed, an open-loop control for keeping the air-to-fuel ratio of the fuel mixture to be at a desired value larger or smaller than the values in the relatively narrow range including the value of the theoretical air-to-fuel ratio is carried out instead of the feedback control performed theretofore when the operation of the engine meets predetermined conditions for the open-loop control. In this open-loop control, an amending coefficient Gk provided for use in a computation conducted on the base of the fundamental quantity of fuel Qs in order to obtain a final quantity of fuel Re which is required for causing the fuel mixture to have a desired air-to-fuel ratio larger or smaller than the theoretical air-to-fuel ratio or approximations thereof, is revised with the renewed average resultant of the learning function, Gfa, so that the final quantity of fuel Re is revised to be increased or decreased in accordance with the renewed average resultant of the learning function, Gfa. Then, the injection control pulse signal OCp corresponding to the revised final quantity of fuel Qe is produced in the control unit 30 and supplied to the fuel injector 6, so that the fuel of the revised final quantity of fuel Re is supplied to the intake passage 2 through the fuel injector 6.

Figure 5:
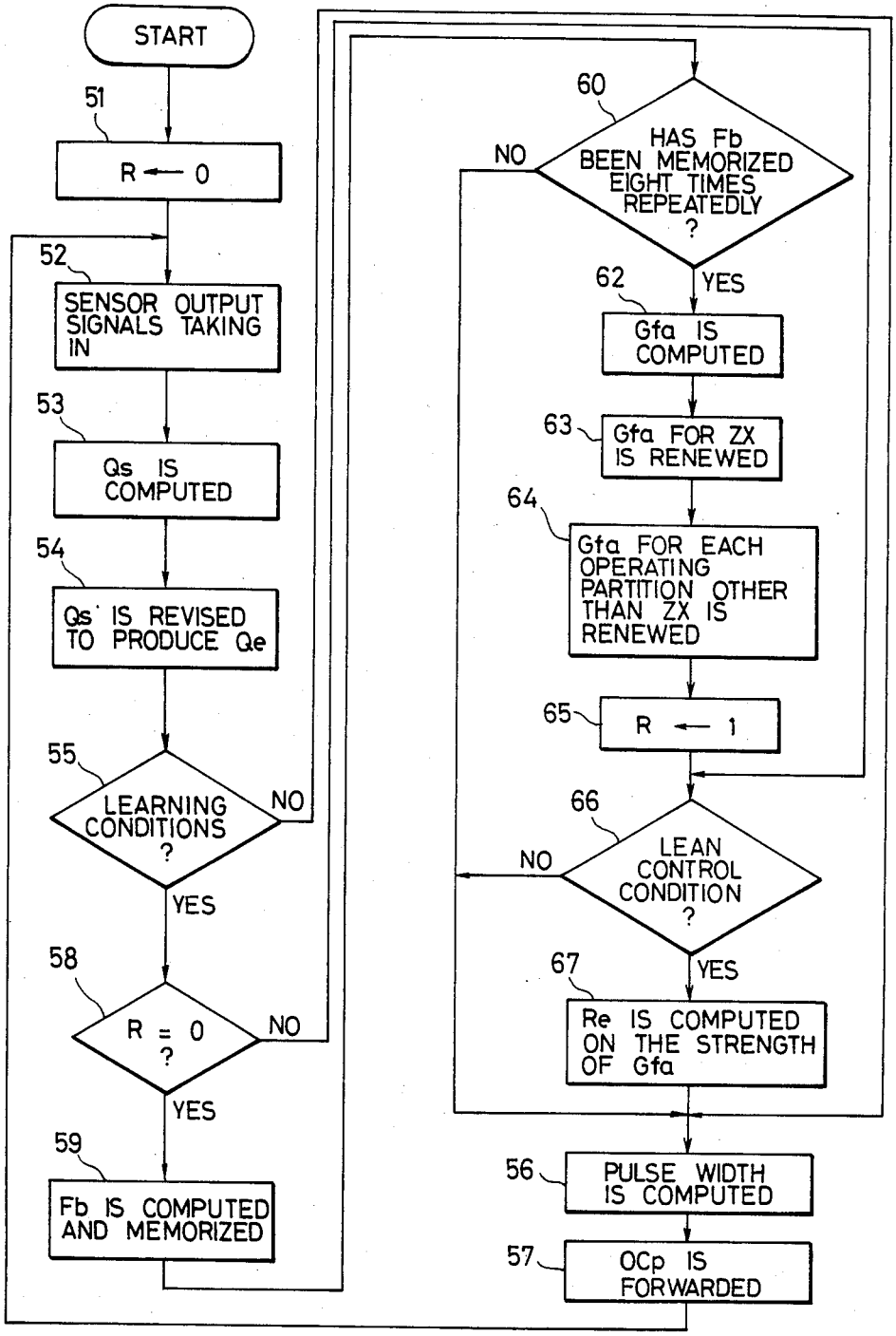
FIG. 5 is a flow chart showing an example of an operation program for a microcomputer used in the control unit employed in the embodiment shown in FIG. 2.

The control operation as described above is effected mainly by the CPU 34 in the control unit 30 and an example of the operation program of the CPU 34 for such control operation is carried out in accordance with a flow chart shown in FIG. 5.

The flow chart shown in FIG. 5 is adopted for conducting the open-loop control for keeping the air-to-fuel ratio at the fuel mixture to be of a desired value larger than the values in the relatively narrow range including the value of the theoretical air-to-fuel ratio so that the fuel mixture is kept lean, under the situation where the RAM 33 in the control unit 30 has the memorizing areas corresponding to the map for learning shown in FIG. 4. This flow chart is started when the ignition key switch 28 is turned on so as to start the engine.

In the initial arrangement in process 51, a flag for learning R is set to 0, and in process 52, the detection output signals ISa, ISt, ISh, ISb, ISs, ISn and ISo are taken in. Next, in process 53, the fundamental or starting quantity of fuel Qs is computed based on the engine speed Ne represented by the detection output signal ISn and the air flow represented by the detection output signal ISa or the air pressure represented by the detection output signal ISb. In process 54, the fundamental quantity of fuel Qs is revised in accordance with the coolant temperature Tw represented by the detection output signal ISs or the air flow temperature represented by the detection output signal ISt so as to produce the final quantity of fuel Qe.

Then, in decision 55, it is checked whether or not the operation of the engine meets the learning conditions. As discussed above, the learning conditions are predetermined to be such conditiones that the coolant temperature Tw is equal to or higher than the predetermined value $T_1$, the voltage level of the detection output signal ISo from the oxygen sensor 27 is equal to or higher than the predetermined value which indicates correct operation of the oxygen sensor 27, and the differential coefficient $d\theta/dt$ for the opening degree of the throttle $\theta$ is in the predetermined range ($\alpha \leqq d\theta/dt < \beta$). When the operation of the engine does not meet the learning conditions, the step is advanced to process 56. In the process 56, a pulse width of the injection control pulse signal OCp is computed based on the final quantity of fuel Qe obtained in the process 54. In process 57, the injection control pulse signal OCp having the pulse width computed in the process 56 is produced and forwarded to the fuel injector 6, then the step is returned to the process 52.

In contrast, if the operation of the engine meets the learning condition, the step is advanced to decision 58 in which it is checked whether or not the flag for learning R is 0. Since the flag for learning R has been set to be 0 in the process 51, first the flag for learning R of 0 is detected and the step is advanced to process 59. In the process 59, the feedback control for keeping the air-to-fuel ratio of the fuel mixture at a value in a relative narrow range which includes the value of the theoretical air-to-fuel ratio is carried out and, under such a feedback control, the learning function is performed for obtaining the average quantity between the peak quantity Pa and the bottom quantity Ba of the fuel supply as shown in FIG. 3 and computing the supplemental feedback quantity of fuel Fb with the use of the obtained average quantity. The supplemental feedback quantity of fuel Fb thus computed is memorized tentatively in the predetermined memorizing portion in the RAM 33 as the resultant of the learning function, Gf.

Then, in decision 60, it is checked whether or not the resultant of the learning function Gf has been memorized eight times repeatedly for one of the operating partitions Z1, Z2, Z3, . . . in the map for learning shown in FIG. 4. If it is determined that the resultant of the learning function, Gf has not been memorized eight times yet, the step is advanced to the process 56 and thereafter further advanced successively in the same manner as discussed above. On the other hand, when the resultant of the learning function, Gf has been memorized eight times for one of the operating partitions Z1, Z2, Z3, . . . , the step is advanced to process 62 and the average resultant of the learning function, Gfa for the operating partition for which the resultant of the learning function, Gf is first memorized eight times (this operating partition is referred to as ZX) is computed in the process 62. This average resultant of the learning function, Gfa, newly computed for the operating partition ZX in the process 62 is memorized in one of the memorizing areas of the RAM 33, which corresponds to the operating partition ZX, so as to renew the average resultant of the learning function, Gfa, previously mamorized therein, in process 63.

Subsequently, in process 64, renewal of the average resultant of the learning function, Gfa memorized in each of the memorizing areas of the RAM 33 corresponding to the remaining operating partitions Z1, Z2, Z3, . . . other than the operating partition ZX is carried out. This renewal is conducted in such a manner that the average between the average resultant of the learning function Gfa newly obtained and memorized in the memorizing area of the RAM 33 corresponding to the operating partition ZX and a former average resultant of the learning function, Gfa previously memorized in each of the memorizing areas of the RAM 33 corresponding to the remaining operating partitions Z1, Z2, Z3, . . . other than the operating partition ZX, is computed, and the computed average is memorized in each of the memorizing areas of the RAM 33 corresponding to the remainging operating partitions Z1, Z2, Z3, . . . other than the operating partition ZX, as a new average resultant of the learning function Gfa, in place of the former average resultant of the learning function, Gfa memorized therein. After the renewal is completed in the process 64, the flag for learning R is set to be 1 in process 65, and then the step is advanced to decision 66.

In the decision 66, it is checked whether or not the operation of the engine meets lean control conditions. The lean control conditions are predetermined to be such contitions that the coolant temperature Tw is equal to or lower than a predetermined value $T_2$, the engine load Le represented by, for example, the air pressure or the air flow is equal to or low than a predetermined value, the engine speed Ne is equal to or lower than a predetermined value $N_2$, and the differential coefficient $d\theta/dt$ for the opening degree of the throttle $\theta$ is in the predetermined range ($\alpha \leqq d\theta/dt < \beta$).

When the operation of the engine meets the lean control conditions, the step is advanced to process 67. In the process 67, the amending coefficient Gk, which is used for obtain the final quantity of fuel Re from the fundamental quantity of fuel Qs in case of the lean control for the fuel mixture, is revised in accordance with the renewed average resultant of the learning function Gfa, and the final quantity of fuel Re is computed based on the fundamental quantity of fuel Qs and the revised amending coefficient Gk. Then, in the process 56, a pulse width of the injection control pulse signal OCp is computed based on the final quantity of fuel Re obtained in the process 67, and in process 57, the injection control pulse signal OCp having the pulse width computed in the process 56 is produced and forwarded to the fuel injector 6, then the step is returned to the process 52. As a result of this, the open-loop control for keeping the fuel mixture at the air-to-fuel ratio larger than the theoretical air-to-fuel ratio, namely, the lean control for the fuel mixture, is performed.

To the contrary, if the operation of the engine does not meet the lean control conditions, the step is advanced to process 56. In the process 56, a pulse width of the injection control pulse signal OCp is computed based on the final quantity of fuel Qe obtained in the process 54, in the same manner as aforementioned, and in process 57, the injection control pulse signal OCp having the pulse width computed in the process 56 is and forwarded to the fuel injector 6, then the step is returned to the process 52. That is, the lean control for the fuel mixture is not carried out.

On the other hand, when it is determined that the flag for learning R is not 0 in the decision 58, that is, the renewal of the average resultant of the learning function Gfa memorized in each of the memorizing areas of the RAM 33 corresponding to the operating partitions Z1, Z2, Z3, . . . has been completed, the step is advanced directly to the decision 66 without performing the process 59, the decision 60 and the process 62, 63, 64 and 65, and thereafter further advanced successively in the same manner as mentioned above.

Next, another example of the operation program of the CPU 34 in the control unit 30 will be explained with reference to a flow chart divided into two parts shown in FIGS. 7A and 7B, respectively.

Figure 7A:
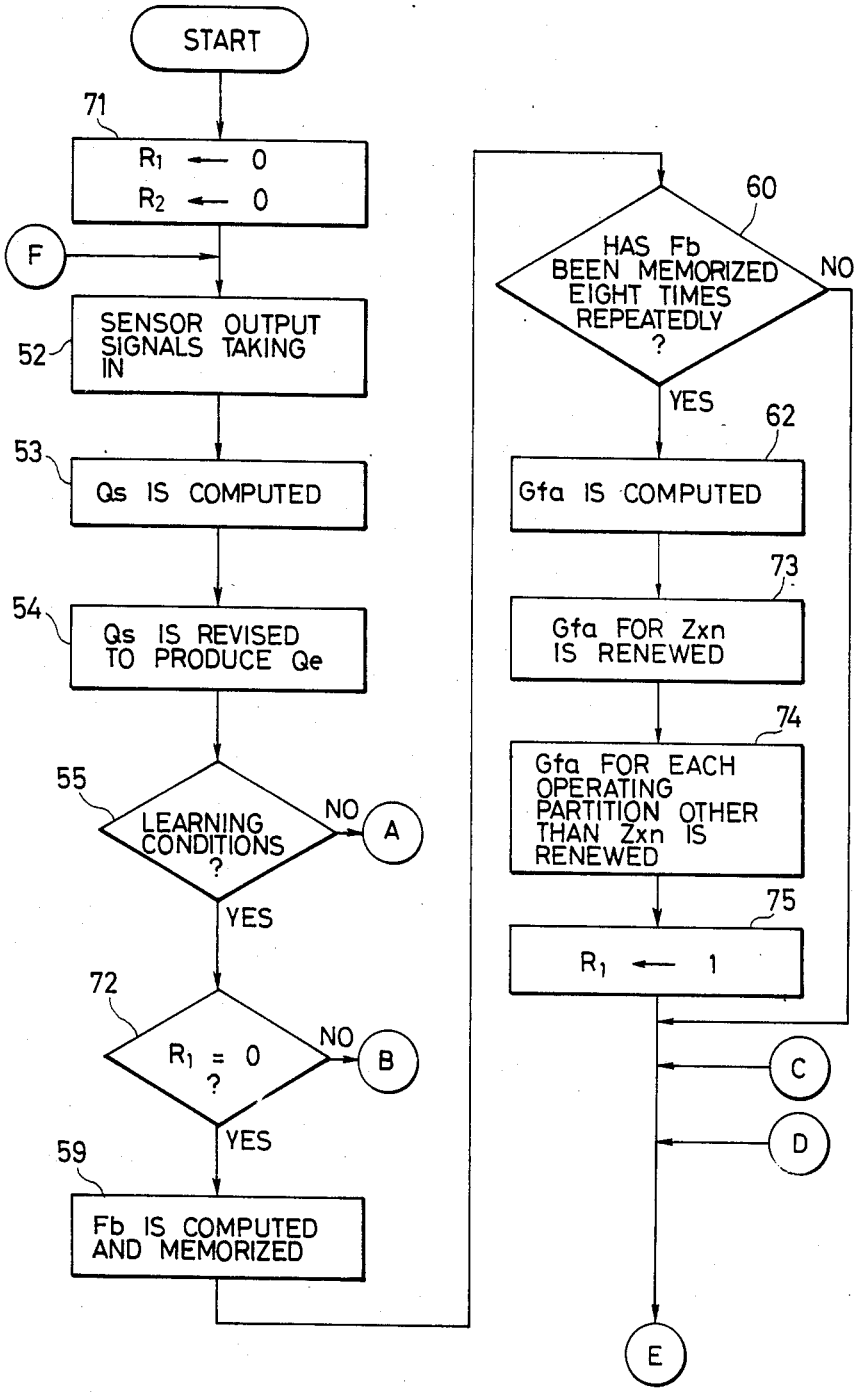
FIGS. 7A and 7B show together a flow chart showing another example of the operation program for the microcomputer used in the control unit employed in the embodiment shown in FIG. 2.
Figure 7B:
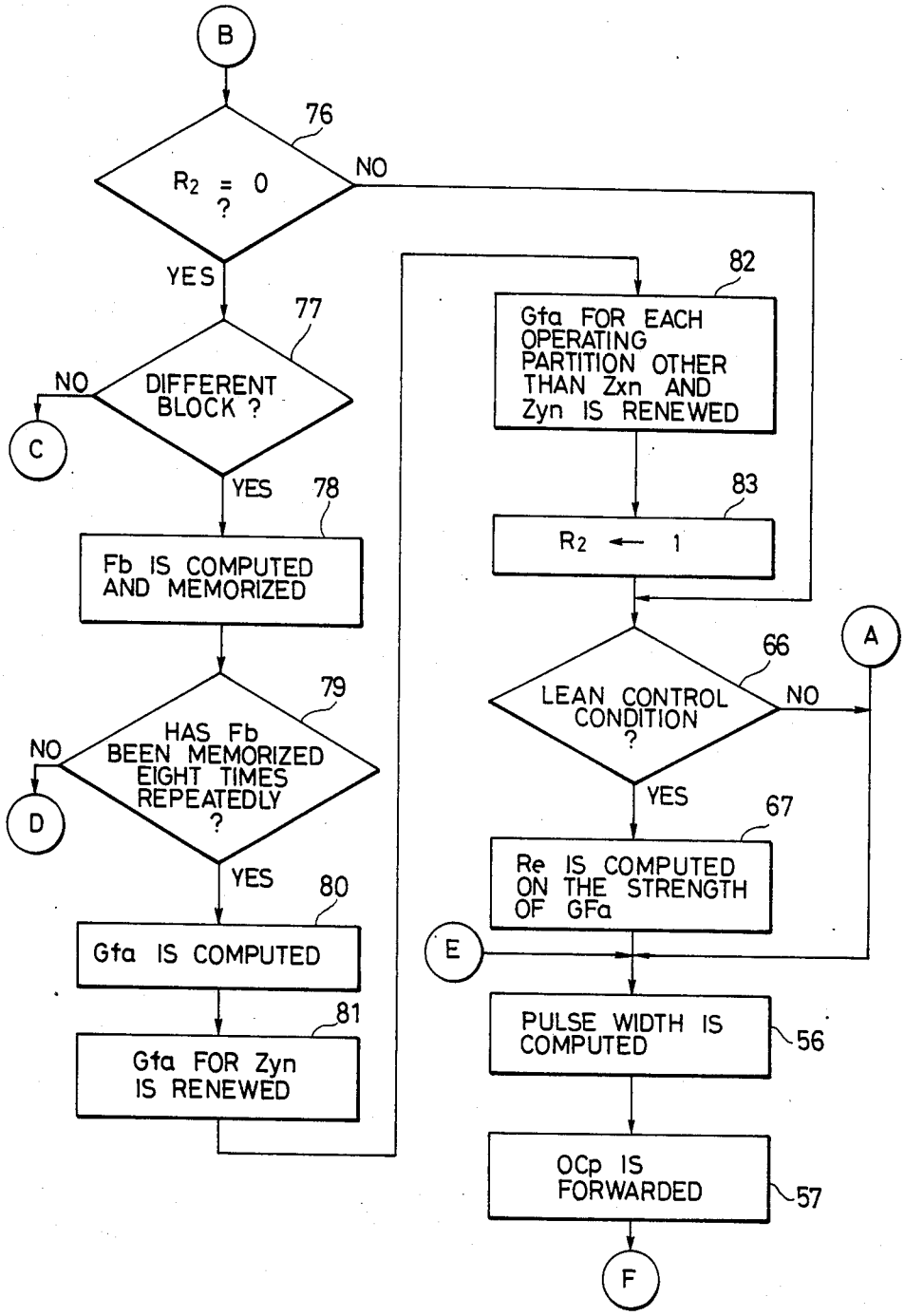

The flow chart shown in FIGS. 7A and 7B is also adopted for conducting the open-loop control for keeping fuel mixture lean, under the situation where the RAM 33 in the control unit 30 has the memorizing areas coresponding to the map for learning shown in FIG. 6. In this flow chart, processes and decisions corresponding to those of the flow chart shown in FIG. 5 are marked with the same references.

Referring to FIGS. 7A and 7B, in the initial arrangement in process 71, first and second flags for learning $R_1$ and $R_2$ are set to 0, respectively, and in process 53, the detected output signals ISa, ISt, ISh, ISb, ISs, ISn and ISo are taken in. Then, in the same manner as the operation following the flow chart shown in FIG. 5, the fundamental or starting quantity of fuel Qs is computed in process 53 and the fundamental quantity of fuel Qs is revised to produce the final quantity of fuel Qe in process 54.

Subsequently, in decision 55, it is determined whether or not the operation of the engine meets the learning condition, in the same manner as the check in the decision 55 of the flow chart shown in FIG. 5. When the operation of the engine does not meet the learning conditions, a pulse width of the injection control pulse signal OCp is computed based on the final quantity of fuel Qe in the process 56, and the injection control pulse signal OCp having the pulse width computed in the process 56 is produced in process 57 and forwarded to the fuel injector 6, then the step is returned to the process 52.

In contrast, if the operation of the engine meets the learning condition, the step is advanced to decison 72 in which it is determined whether or not the first flag for learning $R_1$ is 0. Since the first flag for learning $R_1$ has been set 0 in the process 71, first the first flag for learning $R_1$ of 0 is detected and the step is advanced to process 59. In the process 59, the feedback control for keeping the air-to-fuel ratio of the fuel mixture at a value within the relatively narrow range including the value of the theoretical air-to-fuel ratio is carried out and, under such a feedback control, the learning function is performed for computing the supplemental feedback quantity of fuel Fb. The supplemental feedback quantity of fuel Fb computed is memorized tentatively in the predetermined memorizing portion in the RAM 33 as the resultant of the learning function Gf.

Then, in decision 60, it is determined whether or not the resultant of the learning function Gf has been memorized eight times repeatedly for one of the operating partitions forming the partition blocks AA, AB, AC, AD, . . . in the map for learning shown in FIG. 6. If it is determined that the resultant of the learning function Gf has not been memorized eight times yet, the step is advanced to the process 56 and thereafter further advanced successively in the same manner as mentioned above. On the other hand, if it is determined that the resultant of the learning function Gf has been memorized eight times for one of the operating partitions forming the partition blocks AA, AB, AC, AD, . . . , the step is advanced to process 62 and the average resultant of the learning function Gfa for the operating partition for which the resultant of the learning Gf is first memorized eight times (this operating partition is referred to as Zxn) is computed in the process 62. This average resultant of the learning function Gfa newly computed for the operating partition Zxn in the process 62 is memorized in one of the memorizing areas of the RAM 33, which corresponds to the operating partition Zxn, so as to renew the average resultant of the learning function, Gfa previously memorized therein, in process 73.

Subsequently, in process 74, the renewal of the average resultant of the learning function, Gfa memorized in each of the memorizing areas of the RAM 33 corresponding to the remaining operating partitions forming the partition blocks AA, AB, AC, AD, . . . other than the operating partition Zxn is carried out. For this renewal of the average resultant of the learning function, Gfa, a result of the expresion : $(\gamma \cdot Xn + \delta \cdot Xn - 1)/(\gamma + \delta)$ is calculated. In this expression, Xn stands for the average resultant of the learning function, Gfa newly obtained and memorized in the memorizing area of the RAM 33 corresponding to the operating partition Zxn, Xn−1 stands for a former average resultant of the learning function, Gfa previously memorized in each of the memorizing areas of the RAM 33 corresponding to the remaining operating partitions forming the partition blocks AA, AB, AC, AD, . . . other than the operating partition Zxn, and $\gamma$ and $\delta$ stand for constants, respectively, and $\gamma$ is selected to be equal to $\delta$ when an operating partition for which the average resultant of the learning function, Gfa is renewed belongs to the same partition block as the operating partition Zxn, while $\gamma$ is selected to be different from $\delta$, for example, is equal to $\gamma/7$ when an operating partition for which the average resultant of the learning function, Gfa is renewed belongs to a partition block different from the partition block to which the operating partition Zxn belongs. Then, the calculated result is memorized in each of the memorizing areas of the RAM 33 corresponding to the remaining operating partitions forming the partition blocks AA, AB, AC, AD, . . . other than the operating partition Zxn, as a new average resultant of the learning function, Gfa, in place of the former average resultant of the learning function, Gfa memorized therein. After the renewal is completed in the process 74, the first flag for learning $R_1$ is set to 1 in process 75, then the step is advanced to process 56 and thereafter further advanced successively in the same manner as mentioned above.

On the other hand, when it is determined that the first flag for learning $R_1$ is not 0 in the decision 72, that is, the average resultant of the learning function, Gfa is newly obtained for the operating partition Zxn and the renewal of the average resultant of the learning function, Gfa memorized in each of the memorizing areas of the RAM 33 corresponding to the operating partitions forming the partition blocks AA, AB, AC, AD, . . . has been completed with the average resultant of the learning function, Gfa newly obtained, the step is advanced to the decision 76. In the decision 76, it is determined whether or not the second flag for learning $R_2$ is 0. Since the second flag for learning $R_2$ has been also set to 0 in the process 71, the second flag for learning $R_2$ of 0 is detected immediately after the first flag for learning $R_1$ is set to be 1 and the step is advanced to process 77. In the decision 77, it is determined whether or not the operating partition at that time belongs to a partition block different from the partition block to which the operating partition Zxn belongs. If the operating partition at that time belongs to the same partition block as the operating partition Zxn, the step is advanced to the process 56 and thereafter further advanced in the same manner as mentioned above.

When it is determined in the decision 77 that the operating partition at that time belongs to a partition block different from the partition block to which the operating partition Zxn belongs, the step is advanced to the process 78. In the process 78, the feedback control for keeping the air-to-fuel ration of the fuel mixture at the value in the relatively narrow range which includes the value of the theoretical air-to-fuel ratio is carried out and the supplemental feedback quantity of fuel Fb is computed through the learning function. In this case also, the supplemental feedback quantity of fuel Fb computed is memorized tentatively in a predetermined memorizing portion in the RAM 33 as the resultant of the learning function Gf.

Then, in decision 79, it is determined whether or not the resultant of the learning function Gf has been memorized eight times repeatedly for one of the operating partitions forming the partition blocks AA, AB, AC, AD, . . . in the map for learning shown in FIG. 6. If it is determined that the resultant of the learning function Gf has not been memorized eight times yet, the step is advanced to the process 56 and thereafter further advanced successively in the same manner as mentioned above. On the other hand, if it is determined that the resultant of the learning function Gf has been memorized eight times for one of the operating partitions forming the partition blocks AA, AB, AC, AD, . . . , the step is advanced to process 80 and the average resultant of the learning function Gfa for the operating partition for which the resultant of the learning function Gf is first memorized eight times (this operating partition is referred to as Zyn) is computed in the process 80. This average resultant of the learning function Gfa newly computed for the operating partition Zyn in the process 80 is memorized in one of the memorizing areas of the RAM 33, which corresponds to the operating partition Zyn, so as to renew the average resultant of the learning function Gfa previously memorized therein, in process 81.

Subsequently, in process 82, the renewal of the average resultant of the learning function Gfa memorized in each of the memorizing areas of the RAM 33 corresponding to the remaining operating partitions forming the partition blocks AA, AB, AC, AD, . . . other than the operating partitions Zxn and Zyn is carried out in the same-manner as the renewal carried out in the process 74. After the renewal is completed in the process 82, the second flag for learning $R_2$ is set to 1 in process 83, then the step is advanced to decision 66.

In the decision 66, it is determined whether or not the operation of the engine meets the lean control conditions, in the same manner as the check in the corresponding decision of the flow chart shown in FIG. 5. When the operation of the engine meets the lean control conditions, the step is advanced to process 67. In the process 67, the final quantity of fuel Re required for the lean control is computed based on the fundamental quantity of fuel Qs and the renewed average resultant of the learning Gfa. Then, in the process 56, a pulse width of the injection control pulse signal OCp is computed based on the final quantity of fuel Re obtained in the process 67, and in process 57, the injection control pulse signal OCp having the pulse width computed in the process 56 is produced and forwarded to the fuel injector 6, then the step is returned to the process 52. As a result of this, the open-loop control for keeping the fuel mixture at the air-to-fuel ratio larger than the theoretical air-to-fuel ratio, namely, the lean control for the fuel mixture is performed, after two new average resultants of the learning function Gfa are obtained for the operating partitions Zxn and Zyn belonging to the different partition blocks, respectively, and the renewal of the average resultant of the learning function Gfa memorized in each of the memorizing areas of the RAM 33 corresponding to the operating partitions forming the partition blocks AA, AB, AC, AD, . . . is carried out with each of two new average resultants of the learning function Gfa.

In contrast, when the operation of the engine does not meet the lean control conditions, the step is advanced to process 56. In the process 56, a pulse width of the injection control pulse signal OCp is computed based on the final quantity of fuel Qe obtained in the process 54, in the same manner as aforementioned, and in process 57, the injection control pulse signal OCp having the pulse width computed in the process 56 is produced and forwarded to the fuel injector 6, then the step is returned to the process 52. That is, the lean control for the fuel mixture is not carried out.

Further, when it is determined that the second flag for learning $R_2$ is not 0 in the decision 76, that is, the average resultant of the learning function Gfa is newly obtained for the operating partitions Zyn and the renewal of the average resultant of the learning function Gfa memorized in each of the memorizing areas of the RAM 33 corresponding to the operating partitions forming the partition blocks AA, AB, AC, AD, . . . has been completed with the average resultant of the learning function Gfa newly obtained, the step is advanced directry to the decision 66 and thereafter further advanced successively in the same manner as mentioned above.

Although, each of the above described operation programs of the CPU 34 in the control unit 30 is arranged for the lean control for the fuel mixture, it is to be understood that an operation program of the CPU 34 for an open-loop control for keeping the fuel mixture to have a desired air-to-fuel ratio smaller than the theoretical air-to-fuel ratio, namely, a rich control for the fuel mixture, is also performed in accordance with a flow chart similar to the flow chart shown in FIG. 5 or FIGS. 7A and 7B, in which rich control conditions is provided instead of the lean control conditions.

What is claimed is:

1. An air-to-fuel ratio control system for an internal combustion engine comprising:

air-to-fuel ratio sensing means for producing an output varying in the condition wherein a fuel mixture supplied to a combustion chamber of the engine has the theoretical air-to-fuel ratio so as to discriminate between a first situation where the fuel mixture has an air-to-fuel ratio larger than the theoretical air-to-fuel ratio and a second situation where the fuel mixture has an air-to-fuel ratio smaller than the theoretical air-to-fuel ratio, feedback control means operative to keep the air-to-fuel ratio of the fuel mixture at a value in a relatively narrow range which includes the value of the theoretical air-to-fuel ratio through a feedback control performed in response to the output of said air-to-fuel ratio sensing means, operation detecting means for detecting the operation of the engine, computing means operative to cause said feedback control means to operate in order to conduct the learning function for computing a supplemental feedback quantity of fuel used for revising the quantity of fuel by which the fuel actually supplied to the combustion chamber is determined in at least one of a plurality of partitions of the operating condition of the engine when the operation of the engine detected by said operation detecting means meets predetermined conditions, memory means for storing the supplemental feedback quantity of fuel computed by said computing means in respective storage areas therein partitioned in accordance with the partitions of theoperating condition of the engine as a resultant of the learning function, first memory renewing means for causing said computing means and said memory means to operate for renewing the resultant of the learning function in at least one of the storage areas of said memory means, second memory renewing means for renewing the resultant of the learning function in each of the storage areas of said memory means other than said at least one of the storage areas based on the resultant of the learning function renewed by said first memory renewing means, renewal detecting means for detecting the termination of renewal of the resultants of the learning function by each of the first and second memory renewing means, and fuel supply control means for supplying the fuel of the quantity computed with the resultants of the learning function stored in said memory means, so as to produce the fuel mixture having a desired air-to-fuel ratio different from the theoretical air-to-fuel ratio or approximations thereof after the detection by said renewal detecting means until the termination of the engine operation through an open-loop control under the situation where the operation of the engine meets another predetermined condition.

2. An air-to-fuel ratio control system according to claim 1, wherein said desired air-to-fuel ratio is set to be larger than the theoretical air-to-fuel ratio and approximations thereof.

3. An air-to-fuel ratio control system according to claim 1, wherein said fuel supply control means comprises quantity computing means for computing the quantity of fuel with the resultants of the learning functions stored in said memory means and fuel injection means for injecting the fuel of the quantity computed by said quantity computing means toward the combustion chamber of the engine.

4. An air-to-fuel ratio control system according to claim 1, wherein said renewal detecting means is operative to detect the termination of a specific renewal of the resultants of the learning function, said specific renewal is achieved in such a manner that the resultant of the learning function in each of two storage areas of said memory means is renewed by said first memory renewing means and the resultant of the learning function in each of the storage areas of said memory means other than said two storage areas is renewed by said second memory renewing means.

5. An air-to-fuel ratio control system according to claim 1, wherein said renewal detecting means is operative to detect the termination of a specific renewal of the resultants of the learning function, said specific renewal is achieved in such a manner that the resultant of the learning function in a single storage area of said memory means is renewed by said first memory renewing means and the resultant of the learning function in each of the storage areas of said memory means other than said single storage areas is renewed by said second memory renewing means.

6. An air-to-fuel ratio control system according to claim 1, wherein said second memory renewing means comprises synthesizing means for computing a synthesized resultant of the learning function in accordance with a predetermined relation between the resultant of the learning function renewed by said first memory renewing means and a former resultant of the learning function previously stored in said each of the storage areas of said memory means, and means for storing said synthesized resultant of the learning function in said each of the storage areas of said memory means in place of said former resultant of the learning funciton previously stored therein.

7. An air-to-fuel ratio control system according to claim 2, wherein said renewal detecting means is operative to detect the termination of a specific renewal of the resultants of the learning function, said specific renewal is achieved in such a manner that the resultant of the learning function in a single storage area of said memory means is renewed by said first memory renewing means and the resultant of the learning function in each of the storage areas of said memory means other than said single storage areas is renewed by said second memory renewing means.

8. An air-to-fuel ratio control system according to claim 2, wherein said renewal detecting means is operative to detect the termination of a specific renewal of the resultants of the learning function, said specific renewal is achieved in such a manner that the resultant of the learning function in each of two storage areas of said memory means is renewed by said first memory renewing means and the resultant of the learning function in each of the storage areas of said memory means other than said two storage areas is renewed by said second memory renewing means.

9. An air-to-fuel ratio control system according to claim 8, wherein said second memory renewing means comprises synthesizing means for computing a synthesized resultant of the learning function in accordance with a predetermined relation between the resultant of the learning function renewed by said first memory renewing means and a former resultant of the learning function previously stored in said each of the storage areas of said memory means, and means for storing said synthesized resultant of the learning function in said each of the storage areas of said memory means in place of said former resultant of the learning function previously 10. An air-to-fuel ratio control system according to claim 8, wherein said fuel supply control means comprising additional detecting means for detecting the termination of the engine operation, said additional detecting means detecting also the resumption of the engine operation.

11. An air-to-fuel control system according to claim 9, wherein said fuel supply control means comprises quantity computing means for computing the quantity of fuel with the resultants of the learning function stored in said memory means, and fuel injection means for injecting the fuel of the quantity computed by said quantity computing means toward the combustion chamber of the engine.

12. An air-to-fuel ratio control system according to claim 4, wherein said two storage areas are selected to correspond to two predetermined particular one of the plurality of partitions of the operating condition of the engine, respectively.

13. An air-to-fuel ratio control system for an internal combustion engine comprising:

air-to-fuel ratio sensing means for producing an output varying in the condition wherein a fuel mixture supplied to a combustion chamber of the engine has the theoretical air-to-fuel ratio so as to discriminate between a first situation where the fuel mixture has an air-to-fuel ratio larger than the theoretical air-to-fuel ratio and a second situaiton where the fuel mixture has an air-to-fuel ratio smaller than the theoretical air-to-fuel ratio, feedback control means operative to keep the air-to-fuel ratio of the fuel mixture at a value in a relatively narrow range which includes the value of the theoretical air-to-fuel ratio through a feedback control performed in response to the output of said air-to-fuel ratio sensing means, operation detecting means for detecting a situation where the operation of the engine meets learning conditions and producing a detection output, first computing means for causing said feedback control means to commence to conduct the learning function for computing a supplemental feedback quantity of fuel in a plurality of partitions of the operating condition of the engine in response to the detection output of said operation detecting means, second computing means for causing said first computing means to repeat to conduct the learning function for computing the supplemental feedback quantity of fuel in said plurality of partitions and producing a modified supplemental feedback quantity of fuel, memory means for storing the modified supplemental feedback quantity of fuel produced by said second computing means in respective storage areas therein partitioned in accordance with a plurality of partitions of the operation condition of the engine as a resultant of the learning function, first memory renewing means for causing said second computing means and said memory means to operate for renewing the resultants of the learning funciton in plural memory areas of said memory means, second memory renewing means for renewing the resultant of the learning function in each of the storage areas of said memory means other than said plural memory areas based on the resultant of the learning function renewed by said first memory renewing means, renewal detecting means for detecting the termination of renewal of the resultants of the learning function by each of the first and second memory renewing means, and fuel supply control means for supplying the fuel of the quantity computed with the resultant of the learning function stored in said memory means, soas to make an open-loop control start to produce the fuel mixture having a desired air-to-fuel ratio different from the theoretical air-to-fuel ratio or approximations thereof when the termination of renewal of the resultants of the learning function is detected by said renewal detecting means and thereafter to cause the open-loop control to continue until the termination of the engine operation under the situation where the operation of the engine meets another predetermined condition.

* * * * *